US008336128B2

(12) United States Patent
Murphy

(10) Patent No.: US 8,336,128 B2
(45) Date of Patent: Dec. 25, 2012

(54) WATER-CONSERVING TOILET USING TIMER-CONTROLLED VALVE

(75) Inventor: Audie Murphy, Independence, MO (US)

(73) Assignee: Toilet Technologies Company, LLC, Lee's Summit, MO (US)

( * ) Notice: Subject to any disclaimer, the term of this patent is extended or adjusted under 35 U.S.C. 154(b) by 1441 days.

(21) Appl. No.: 11/873,874

(22) Filed: Oct. 17, 2007

(65) Prior Publication Data

US 2008/0120770 A1 May 29, 2008

Related U.S. Application Data

(60) Provisional application No. 60/867,477, filed on Nov. 28, 2006.

(51) Int. Cl.
*E03D 1/14* (2006.01)

(52) U.S. Cl. ..... 4/324

(58) Field of Classification Search ..... 4/324
See application file for complete search history.

(56) References Cited

U.S. PATENT DOCUMENTS

| | | | | |
|---|---|---|---|---|
| 3,010,115 | A | 11/1961 | Wiggs | |
| 4,044,407 | A | 8/1977 | Silcox | |
| 4,333,185 | A | 6/1982 | Heinze | |
| 5,067,181 | A | 11/1991 | Hafner | |
| 5,241,711 | A | 9/1993 | Badders | |
| 5,832,546 | A | 11/1998 | Inch | |
| 5,970,527 | A | 10/1999 | Martin | |
| 6,343,387 | B1 | 2/2002 | Beh | |
| 6,421,843 | B1 | 7/2002 | Mellinger | |
| 2005/0039797 | A1 | 2/2005 | Carlson | |
| 2006/0179560 | A1 | 8/2006 | Ouyoung | |
| 2007/0200078 | A1 * | 8/2007 | Parsons et al. | 251/129.04 |
| 2009/0121171 | A1 * | 5/2009 | Parsons et al. | 251/129.15 |

OTHER PUBLICATIONS

Microflush Models LF-810 and LF-820, Microphor, A Wabtec Company, Willits, CA, Mar. 8, 2002.

Model LF-810 and LF-820 Air Operated Microflush 16-Ounce Flush Toilets Installation/Service Manual, Microphor, a Wabtec Company, Willits, CA, Apr. 2003.

* cited by examiner

*Primary Examiner* — Lori Baker
(74) *Attorney, Agent, or Firm* — Spencer Fane Britt & Browne LLP

(57) ABSTRACT

A water-conserving blowout toilet (10) includes a valve (14), such as a globe valve, connected to a timing mechanism (16) for determining a volume of water flowing to a toilet bowl (32) independent of water flow, a bowl (32) having a lower portion (36) defining a volume of space such that a minimal amount of the water is sufficient to cover and seal a waste outlet (34), and a distribution manifold (22) for distributing the water into the bowl (32) for maximum effect. In another embodiment, the toilet (10) uses approximately 1.0 gallon of water per flush, with approximately 0.5 gallons being used to flush waste from the bowl (32), and approximately 0.5 gallons being used to cover and seal the waste outlet (34). In one embodiment, upper and lower portions (133,136) of the bowl (132) are constructed separately and then joined together.

8 Claims, 4 Drawing Sheets

SECTIONAL VIEW "I–I"

WATER-CONSERVING TOILET USING TIMER-CONTROLLED VALVE

RELATED APPLICATIONS

The present non-provisional patent application is related to and claims priority benefit of an earlier-filed provisional patent application of the same title, Ser. No. 60/867,477, filed Nov. 28, 2006. The identified earlier-filed application is hereby incorporated by reference as though fully set forth herein.

FIELD OF THE INVENTION

The present invention relates to toilets of the type generally referred to as "blowout" toilets. More specifically, the present invention concerns a blowout toilet which uses less than 1.6 gallons of water per flush, and which includes a valve connected to a timing mechanism for determining a volume of water flowing to a toilet bowl independent of water flow, a bowl with a volume and shape such that a minimal amount of the water is sufficient to cover and seal a waste outlet, and a distribution manifold for distributing the water into the bowl for maximum effect.

BACKGROUND OF THE INVENTION

In many residential toilets, a volume of water is stored in a water tank located above the toilet. When the toilet is flushed, gravity moves the water from the water tank into the toilet bowl and, from there, through a waste outlet connected to a sewer pipe. Toilets of this type may use between 1.6 and 5 gallons of water per flush.

In many commercial and institutional toilets, generally referred to as "blowout" toilets, the aforementioned water tank is eliminated in favor of a flush valve, generally referred to as a "flushometer", which directs pressurized water from a water supply line into upper and lower portions of the bowl. In toilets of this type, the volume of water needed to close, or reset, the flushometer, and the volume of water needed to reseal the bowl against migrating sewer gas, establish a minimum amount of water needed to accomplish each flush.

More specifically, the flushometer delivers a predetermined, metered amount of pressurized water to the bowl so as to use less water while providing at least the same flushing effectiveness as the conventional residential toilet which uses the force of gravity to deliver water into the bowl. Within the flushometer, a diaphragm or piston separates upper and lower chambers. When the flushometer is actuated, the diaphragm or piston is lifted from its seat, which allows water to flow. A small amount of the flowing water is diverted into the upper chamber to eventually reseat the diaphragm or piston and thereby reset the flushometer for the next flush. Thus, while the flushometer is mechanically or electronically actuated in response to an actuation action or signal, it is reset substantially automatically by the action of the water flowing through it. The minimum amount of water that must be diverted to reseat the diaphragm or piston and thereby reset the flushometer establishes the minimum amount of water that must flow through the flushometer and into the bowl during flushing.

Furthermore, the waste outlet from the bowl is connected directly to a sewer line. The water maintained in the bowl between flushings covers and seals the outlet. If the water level is not sufficient to fully cover and seal the outlet, then sewer gas in the sewer line can migrate into the bowl. Thus, the minimum amount of water needed to cover and seal the outlet further establishes the minimum amount of water that must flow into the bowl during flushing.

Available blowout toilets use 1.6 gallons or more per flush cycle, with, for example, 0.85 gallons being used to flush waste from the bowl, and the remaining 0.75 gallons being used to cover and seal the outlet. Using any less water would likely either adversely affect the proper functioning of the flushometer or fail to cover and seal the outlet.

SUMMARY OF THE INVENTION

The present invention overcomes the above-discussed and other problems by providing a toilet which advantageously allows for flushing waste effectively while using substantially less water per flush than conventional flushometer-based blowout toilets. In one embodiment, the toilet uses less than 1.6 gallons of water per flush. In another embodiment, the toilet uses approximately 1.0 gallon of water per flush, with approximately 0.5 gallons being used to flush waste from its bowl, and approximately 0.5 gallons being used to cover and seal its waste outlet. In yet another embodiment, the toilet uses as little as approximately 0.8 gallons per flush.

In one embodiment, the toilet broadly comprises a valve interposed between a pressurized water supply and the toilet bowl for controlling a volume of water flowing from the water supply to the toilet bowl, and a timing mechanism connected to the valve for controlling an amount of time that the valve allows water to flow from the water supply to the toilet bowl. The valve may be a globe valve, and the timing mechanism may be electronic. The toilet may further include a water chamber interposed between the valve and the toilet bowl for receiving and dispensing the volume of water. The toilet may further include a distribution manifold interposed between the valve and the toilet bowl for distributing the volume of water between at least a first flowpath leading to an upper portion of the toilet bowl and a second flowpath leading to a lower portion of the toilet bowl. The toilet may further include a wash-down jet connected to the first flowpath at the upper portion of the toilet bowl and having a plurality of openings for discharging water into the upper portion, and a flush jet connected to the second flowpath at the lower portion of the toilet bowl for discharging water into the lower portion. The lower portion of the toilet bowl may define a volume of space such that a minimal amount of the water is sufficient to cover and seal the waste outlet.

In one embodiment, the upper and lower portions of the toilet bowl are constructed separately and then joined together. For example, the upper portion may be constructed of deep-drawn stainless steel, the lower portion may be constructed of die cast stainless steel, and the two portions may be welded together to form the final toilet bowl. The upper portion may have a smooth, shallow sweeping shape, and the lower portion may have a generally concave and relatively steep-sided flushing cavity.

These and other features of the present invention are described in greater detail in the section below titled DETAILED DESCRIPTION OF THE INVENTION.

BRIEF DESCRIPTION OF THE DRAWING FIGURES

A preferred embodiment of the present invention is disclosed herein with references to the drawing figures, wherein.

DETAILED DESCRIPTION OF THE INVENTION

Figure 1:
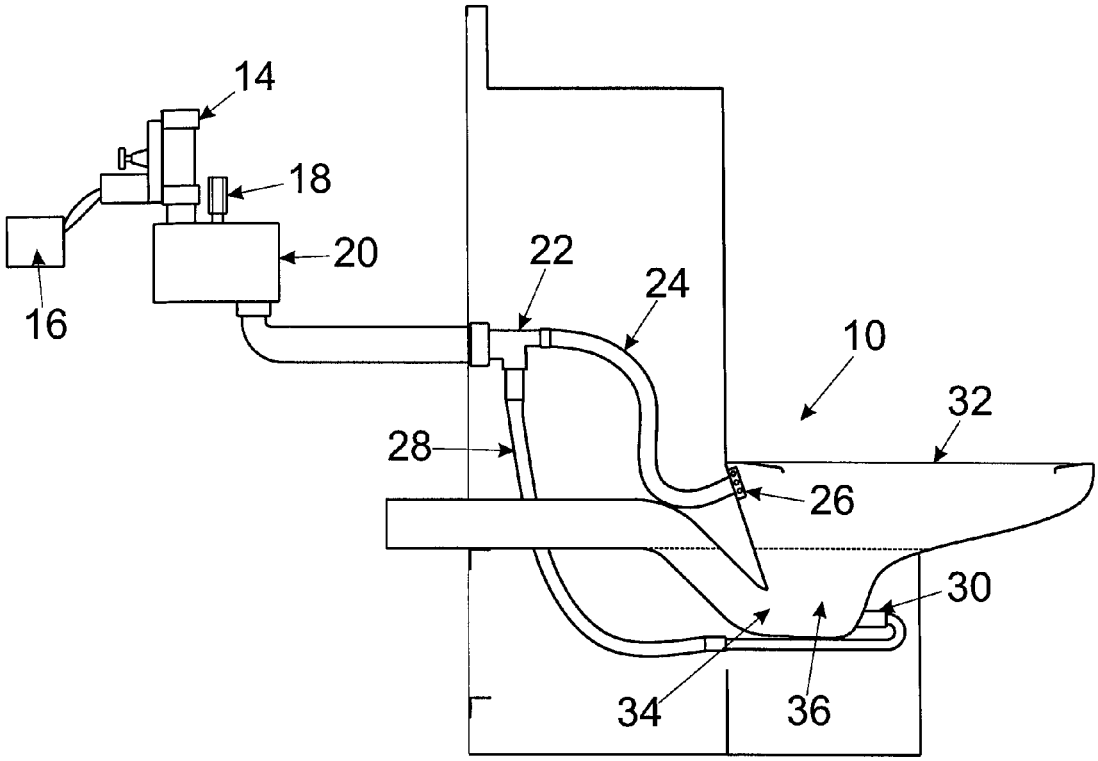
FIG. 1 is a system diagram of an embodiment of the toilet of the present invention.

With reference to the figures, a water-conserving toilet 10 is herein described, shown, and otherwise disclosed in accordance with preferred embodiments of the present invention. In one embodiment the toilet 10 uses less than 1.6 gallons of water per flush and in another embodiment uses approximately between 0.8 and 1.2 gallons of water. In yet another embodiment, the toilet 10 uses approximately 1.0 gallons of water per flush, with approximately 0.5 gallons being used to flush waste from its bowl 32, and approximately 0.5 gallons being used to cover and seal its waste outlet 34.

Referring particularly to FIG. 1, in one embodiment the toilet 10 broadly comprises a valve 14, a timing mechanism 16, a vacuum breaker 18, a water chamber 20, a distribution manifold 22, a first supply tube 24 and a wash-down jet 26, a second supply tube 28 and a flush jet 30, the toilet bowl 32, and the waste outlet 34.

The valve 14 is connected to a pressurized water supply and controls the volume of water flowing from the water supply to the water chamber 20 and, ultimately, to the toilet bowl 32. More specifically, the valve 14 controls the volume of water based upon the amount of time the valve 14 remains open. The timing mechanism 16 is incorporated into or connected to the valve 14 and determines the amount of time the valve 14 remains open independent of any action of the water actually flowing through the valve 14. In one embodiment, the valve 14 is a globe valve which includes an internal baffle and which allows for relatively fine control over throttling the flow of water through the valve 14. In various embodiments, the valve 14 and/or the timing mechanism 16 are electrical, mechanical, or a combination thereof in nature. More specifically, in one embodiment, the timing mechanism 16 is electronic in nature and settable to a desired amount of time at the expiration of which an electronic signal is generated and communicated to close the valve 14. In one embodiment, the valve 14 is or is replaced with a flushometer valve; the flushometer valve may have a built-in timing mechanism. One suitable valve which may be used as the valve of the present invention is an electronic globe valve, manufactured by The Toro Company, which operates on 24 VAC, is internally ported and normally closed, and includes a manual bleed assembly and an adjustable flow control.

The vacuum breaker 18 is located generally downstream of the valve 14, and functions to breaks suction resulting from a reversed flow condition, and thereby prevents contaminated water from siphoning back into the general water supply.

Figure 2:
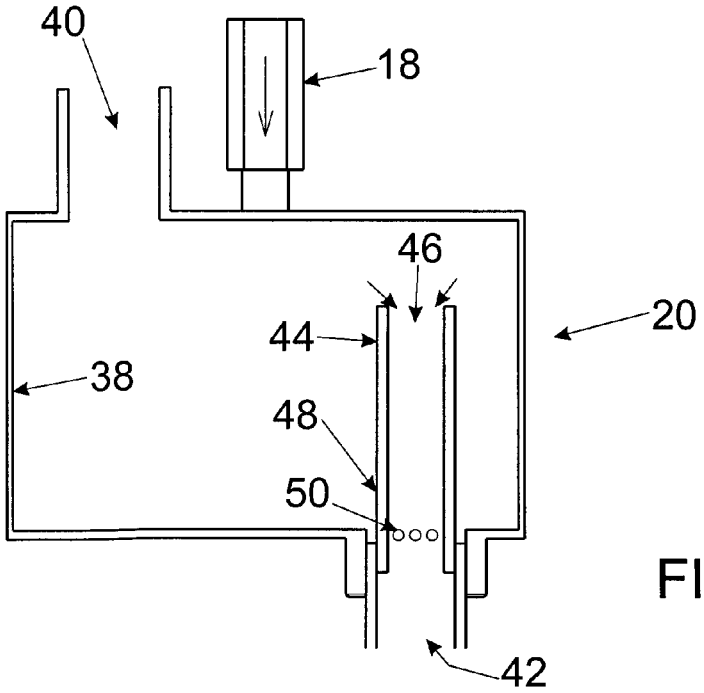
FIG. 2 is a sectional elevation view of a water chamber component of the toilet of FIG. 1.
Figure 3:
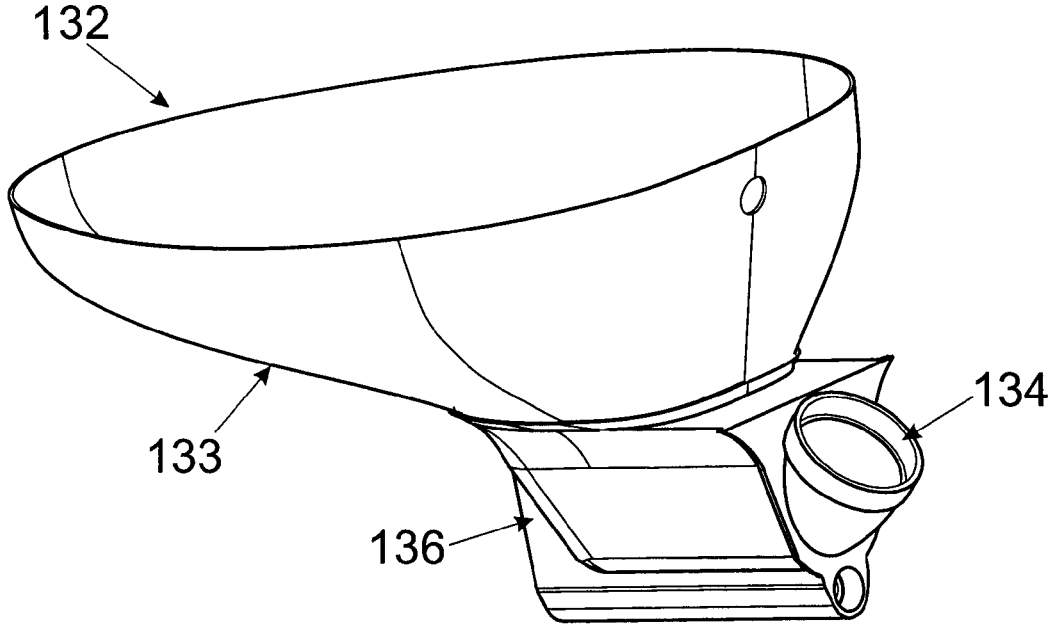
FIG. 3 is a perspective view of an embodiment of a bowl component of the toilet of FIG. 1.

The water chamber 20 is located downstream of the valve 14 and is operationally connected thereto to receive and dispense the volume of water. Referring also to FIG. 2, in one embodiment the water chamber 20 includes a housing 38 having an inlet 40 and an outlet 42, a hold-back tube 44 having an upper end 46, a lower end 48, and one or more drain holes 50. The housing 38 generally defines the capacity of the chamber 20 which, in the present invention, corresponds approximately to the 1.6 gallons or less of water used per flush. The inlet port 40 is coupled with the valve 14. The outlet port 42 is coupled with the distribution manifold 22. The upper end 46 of the hold-back tube 44 is open to allow water to drain therethrough and exit the chamber 20. The lower end 48 of the hold-back tube 44 is coupled with the outlet port 42. The one or more drain holes 50 are located on the lower end 48 to allow for a slow release of water to drain therethrough and exit the chamber 20.

The distribution manifold 22 is located downstream of the water chamber and is operationally connected thereto, and distributes water flowing out of the water chamber 20 between at least two flowpaths, with a first flowpath leading to an upper portion of the bowl 32 and a second flowpath leading to the lower portion 36. The distribution manifold 22 includes a first outlet corresponding to the first flowpath and a second outlet corresponding to the second flowpath. The first supply tube 24 further defines the first flowpath and extends between and connects the distribution manifold 22 and the wash-down jet 26. More specifically, the first supply tube 24 includes a first end and a second end, with the first end being connected to the first outlet of the distribution manifold 22, and the second end being connected to the wash-down jet 26. The wash-down jet 26 includes one or more openings for discharging water at or into a rim area of the bowl 32 during flushing.

The second supply tube 28 further defines the second flowpath and extends between and connects the distribution manifold 22 and the flush jet 30. More specifically, the second supply tube 28 includes a first end and a second end, with the first end being connected to the second outlet of the distribution manifold 22, and the second end being connected to the flush jet 30. The flush jet 30 is connected to the lower portion 36 of the bowl 32, and includes one or more openings for discharging water at or into the lower portion 36 of the bowl 32 during flushing.

The toilet bowl 32 receives waste in a substantially conventional manner. The waste outlet 34 is associated with the lower portion 36 of the bowl 32 and carries waste out of the bowl 32 during flushing. The lower portion 36 of the bowl 32 holds an amount of water which is sufficient to cover and seal the outlet 34 and thereby prevent sewer gas from migrating into the bowl 32. The shape of the lower portion 36 is such as to minimize the amount of water needed to cover and seal the outlet 34. In one embodiment, no more than approximately 0.5 gallons are required to sufficiently fill the lower portion 36 and cover and seal the outlet 34. In one embodiment, the shape of the lower portion 36 is generally concave with relatively steep sides to better define the concavity and thereby minimize the volume that it defines and the amount of water needed to fill it.

Figure 4:
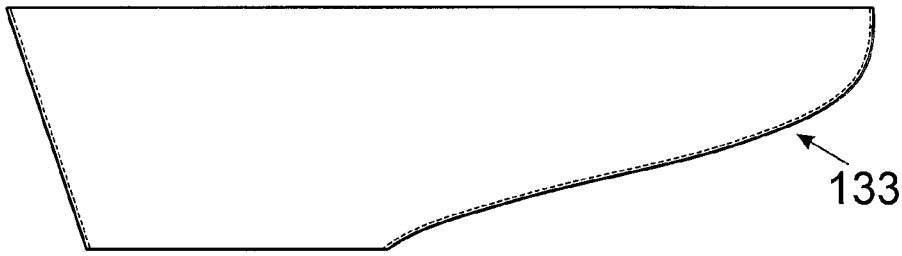
FIG. 4 is a sectional elevation view of an upper portion of the bowl component.
Figure 5:
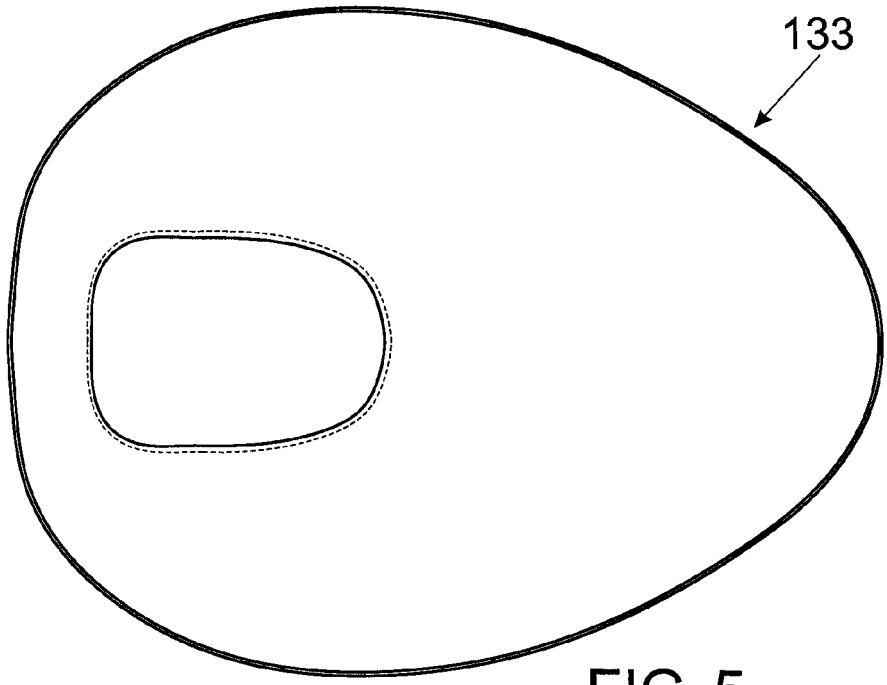
FIG. 5 is a plan view of the upper portion of the bowl component.
Figure 6:
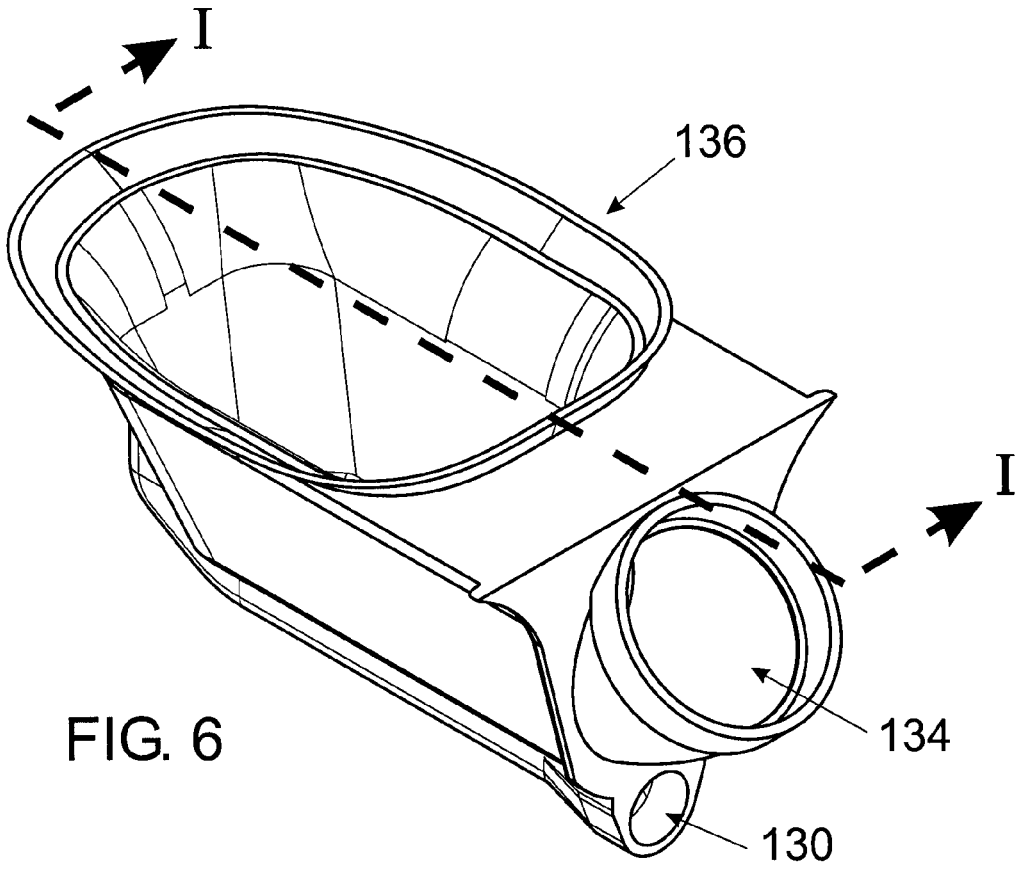
FIG. 6 is an isometric view of a lower portion of the bowl component.
Figure 7:
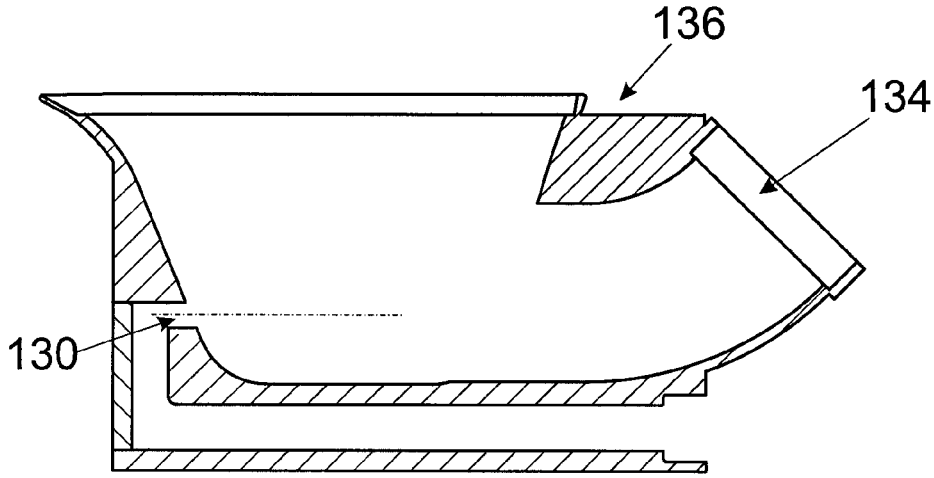
FIG. 7 is a sectional view of the lower portion of the bowl component.

Referring to FIGS. 3-8, one embodiment of the toilet bowl 132 includes the upper portion 133 and the lower portion 136 which are welded or otherwise joined together to form the bowl 132. Such separate construction allows for using different construction techniques appropriate or necessary to achieve the desired shapes of the portions 133,136. Referring particularly to FIGS. 4 and 5, the upper portion 133 has a smooth, shallow sweeping shape and allows for a large water spot which is necessary for sanitation, and, in one embodiment, is constructed from deep-drawn stainless steel. Referring particularly to FIGS. 6 and 7, the lower portion 136 provides the flushing cavity in which waste collects while awaiting evacuation, and, in one embodiment, is constructed of die-cast stainless steel. Thus, as a whole, the bowl 132 has a smooth, shallow sweeping shape that transitions into the generally concave and relatively steep-sided flushing cavity, and which allows for extremely efficient flushing, including flushes using as little as approximately 0.8 gpf.

In one embodiment, the smooth, shallow sweeping shape of the upper portion 133 includes an upper opening of approximately between 17 and 19 inches in length, i.e., maximum dimension, and approximately between 13 and 15 inches in width, i.e., minimum dimension; a height of approximately between 4 and 6 inches; and a lower opening of approximately between 5 and 7 inches in length, i.e., maximum dimension and approximately between 3.5 and 5.5 inches in width, i.e., minimum dimension. In a more specific embodiment, the upper opening is approximately between 17.5 and 18.5 inches in length, i.e., maximum dimension, and approximately between 13.5 and 14.5 inches in width, i.e., minimum dimension; the height is approximately between 4.5 and 5.5 inches; and the lower opening is approximately between 5.5 and 6.5 inches in length, i.e., maximum dimension and approximately between 4 and 5 inches in width, i.e., minimum dimension. Characterized another way, the maximum dimension of the upper opening is approximately 3 times as large as the maximum dimension of the lower opening, and approximately 3.5 times as large as the height, i.e., the vertical distance separating the upper and lower openings.

In one embodiment, the steep-sided flushing cavity of the lower portion 136 includes an upper opening of approximately between 6 and 8 inches in length, i.e., maximum dimension, and approximately between 4.5 and 6.5 inches in width, i.e., minimum dimension, and a height of approximately between 2.5 and 4.5 inches. In a more specific embodiment, the upper opening is approximately between 6.5 and 7.5 inches in length, i.e., maximum dimension, and approximately between 5 and 6 inches in width, i.e., minimum dimension, and the height is approximately between 3 and 4 inches. In one embodiment, the sides of the flushing cavity of the lower portion 136 are oriented approximately between 45 degrees and 90 degrees relative to a horizontal plane extending through a base of the lower portion 136; in a more specific embodiment, approximately between 55 degrees and 90 degrees relative to that plane; and, in an even more specific embodiment, approximately between 65 degrees and 90 degrees relative to that plane.

Figure 8:
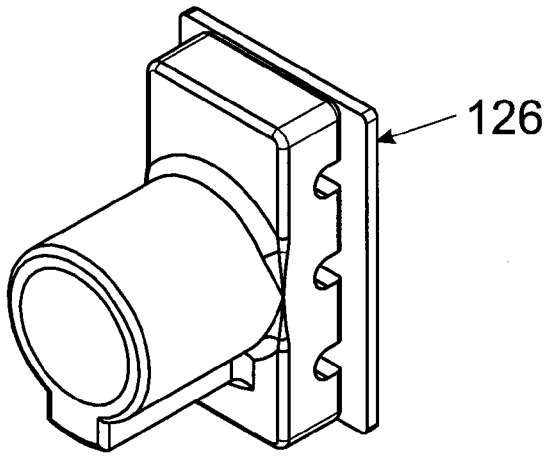
FIG. 8 is an isometric view of an embodiment of a wash-down jet fixture of the toilet of FIG. 1.

In one embodiment, the bowl 132 has a rimless wash-down toilet seat. Referring also to FIG. 8, the bowl further includes the wash-down jet 126 mounted below the toilet seat at a back area of the upper portion 133 of the bowl 132. The wash-down jet 126 shoots water in both directions around the upper portion 133 of the bowl 132 to both clean and refill the bowl 132 after evacuation.

The bowl 132 further includes the flush jet 130 mounted at a front area of the lower portion 136 of the bowl 132. When the toilet is flushed, the flush jet 130 emulsifies and pushes the waste out of the flushing cavity and into and through the outlet 134 at the rear of the lower portion 136 of the bowl 132.

In use, an embodiment of the toilet 10 may function substantially as follows. A flush signal is received at the valve 14, causing the valve 14 to open and the timing mechanism 16 to start timing the preset period of time. The open valve 14 allows the volume of water to flow into the water chamber 20 until the timing mechanism 16 causes the valve 14 to close. The volume of water flows out of the water chamber 20 and toward the distribution manifold 22. At the distribution manifold 22, the volume of water is distributed along the first and second flowpaths. Water flowing along the first flowpath exits the wash-down jet 26 at the upper portion of the bowl 32. Water flowing along the second flowpath exits the flush jet 30 at the lower portion 36 of the bowl 32. In this particular example, approximately 0.5 gallons of the water exits the bowl 32 via the waste outlet 34, and approximately 0.5 gallons of the water remains in the lower portion 36 of the bowl 32 to cover and seal the waste outlet 34.

From the preceding description, it will be appreciated that the toilet 10 of the present invention advantageously allows for flushing waste effectively while using substantially less water per flush than conventional flushometer-based blowout toilets. The toilet 10 includes the valve 14 connected to the timing mechanism 16 for determining the volume of water flowing to the toilet bowl 32 independent of water flow, rate, and/or volume, the bowl 32 having the lower portion 36 defining a volume of space such that a minimal amount of the water is sufficient to cover and seal the waste outlet 34, and the distribution manifold 22 for distributing the water into the bowl 32 for maximum effect.

Having thus described the preferred embodiments of the invention, what is claimed as new and desired to be protected by Letters Patent includes the following:

1. A toilet comprising:

a toilet bowl having an upper portion and a lower portion;

a valve interposed between a pressurized water supply and the toilet bowl for controlling a volume of water flowing from the water supply to the toilet bowl a timing mechanism connected to the valve for controlling an amount of time that the valve allows water to flow from the water supply to the toilet bowl, wherein the valve and the timing mechanism cooperate to limit the volume of water to less than 1.6 gallons;

a water chamber interposed between the valve and the toilet bowl for receiving and dispensing the volume of water; and a distribution manifold interposed between the valve and the toilet bowl for distributing the volume of water between at least a first flowpath leading to the upper portion of the toilet bowl and a second flowpath leading to the lower portion of the toilet bowl.

2. The toilet as set forth in claim 1, wherein the valve is a globe valve, and the timing mechanism is electronic.

3. The toilet as set forth in claim 1, further including:

a wash-down jet connected to the first flowpath at the upper portion of the toilet bowl and having a plurality of openings for discharging water into the upper portion; and a flush jet outlet connected to the second flowpath at the lower portion of the toilet bowl for discharging water into the lower portion.

4. The toilet as set forth in claim 1, wherein:

the upper portion has a smooth, shallow, sweeping shape; and the lower portion has a concave and steeply-sided flushing cavity, wherein the upper and lower portions are separately constructed and then joined together to form the toilet bowl.

5. In a blowout toilet including a toilet bowl having an upper portion and a lower portion, wherein the lower portion includes a waste outlet connected to a sewer system, and the toilet bowl being connected to a pressurized water supply, and further including a water chamber interposed between the pressurized water supply and the toilet bowl for receiving and dispensing a volume of water, the improvements comprising:

the lower portion defining a volume of space such that no more than approximately 0.5 gallons of water is sufficient to cover and seal the waste outlet;

a valve interposed between the pressurized water supply and the toilet bowl for determining the volume of water flowing from the pressurized water supply to the toilet bowl;

a timing mechanism connected to the valve for controlling an amount of time that the valve allows water to flow from the pressurized water supply to the toilet bowl, wherein the valve and the timing mechanism cooperate to limit the volume of water to less than 1.6 gallons; and a distribution manifold interposed between the valve and the toilet bowl for distributing the volume of water between at least a first flowpath leading to the upper portion of the toilet bowl and a second flowpath leading to the lower portion of the toilet bowl.

6. The blowout toilet as set forth in claim 5, wherein the valve is a flushometer valve having a built-in timing mechanism.

7. The blowout toilet as set forth in claim 5, the improvements further including:

a wash-down jet connected to the first flowpath at the upper portion of the toilet bowl and having a plurality of openings for discharging water into the upper portion; and a flush jet connected to the second flowpath at the lower portion of the toilet bowl for discharging water into the lower portion.

8. The blowout toilet as set forth in claim 5, the improvements further including:

the upper portion having a smooth, shallow, sweeping shape; and the lower portion having a concave and steeply-sided flushing cavity, wherein the upper and lower portions are separately constructed and then joined together to form the toilet bowl.

* * * * *